US010466603B2

(12) United States Patent
Anezaki et al.

(10) Patent No.: US 10,466,603 B2
(45) Date of Patent: Nov. 5, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takashi Anezaki, Hiratsuka (JP); Taichi Sato, Numazu (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/201,713

(22) Filed: Nov. 27, 2018

(65) Prior Publication Data

US 2019/0163078 A1 May 30, 2019

(30) Foreign Application Priority Data

Nov. 30, 2017 (JP) ..... 2017-230511

(51) Int. Cl.

| | |
|---|---|
| ***G03G 5/00*** | (2006.01) |
| ***G03G 5/05*** | (2006.01) |
| ***G03G 15/04*** | (2006.01) |
| ***G03G 5/06*** | (2006.01) |
| ***G03G 21/18*** | (2006.01) |
| ***G03G 5/14*** | (2006.01) |

(52) U.S. Cl.
CPC ..... *G03G 5/0567* (2013.01); *G03G 5/0662* (2013.01); *G03G 5/144* (2013.01); *G03G 15/04036* (2013.01); *G03G 21/1814* (2013.01)

(58) Field of Classification Search
CPC ..... G03G 5/144
USPC ..... 430/63
See application file for complete search history.

(56) References Cited

FOREIGN PATENT DOCUMENTS

JP 2009-058789 A 3/2009

*Primary Examiner* — Mark A Chapman
(74) *Attorney, Agent, or Firm* — Canon USA, Inc., IP Division

(57) ABSTRACT

An electrophotographic photosensitive member includes a support member, an electroconductive layer, and a photosensitive layer, in this order. The electroconductive layer contains a binder resin, electrically conductive first metal oxide particles, and second metal oxide particles. The refractive index Rb of the binder resin, the refractive index Rc of the first metal oxide particles, and the refractive index Rh of the second metal oxide particles satisfy the relationships: $|Rb-Rc| \leq 0.35$ and $|Rb-Rh| \geq 0.65$. The electroconductive layer has a volume resistivity of $1.0 \times 10^6$ Ω·cm to $1.0 \times 10^{13}$ Ω·cm, and the ratio of the specific gravity of the first metal oxide particles to the specific gravity of the second metal oxide particles is 0.85 to 1.20.

11 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus that include the electrophotographic photosensitive member.

Description of the Related Art

At least some of the electrophotographic photosensitive members used in electrophotographic apparatuses have an electroconductive layer between a support member and a photosensitive layer to hide defects, such as splinters, at the surface of the support member. In this instance, the electroconductive layer contains metal oxide particles having a high optical opacity and a binder resin capable of binding the metal oxide particles. In an electrophotographic photosensitive member, furthermore, highly conductive metal oxide particles are added to the electroconductive layer from the viewpoint of ensuring an electrical conduction in the electroconductive layer (Japanese Patent Laid-Open No. 2009-58789).

Japanese Patent Laid-Open No. 2009-58789 discloses an electrophotographic photosensitive member including an electroconductive layer containing titanium oxide particles, composite particles produced by coating barium sulfate particles with tin oxide, and a binder resin. In a layer containing plural types of metal oxide particles and a binder resin, in general, one of the plural types having a larger difference in refractive index from the binder resin has a higher optical opacity than the other. In the electroconductive layer disclosed in the above-cited document, the difference in refractive index between the composite particles and the binder resin is small, and the further added titanium oxide particles, which have a large difference in refractive index from the binder resin, probably function to increase the optical opacity of the electroconductive layer.

SUMMARY OF THE INVENTION

The present disclosure provides an electrophotographic photosensitive member that can hide defects at the surface of the support member and reduce variation in potential accompanying repeated use.

Accordingly, an aspect of the present disclosure provides an electrophotographic photosensitive member including a support member, an electroconductive layer, and a photosensitive layer, in this order. The electroconductive layer contains a binder resin, electrically conductive first metal oxide particles, and second metal oxide particles. The refractive index Rb of the binder resin, the refractive index Rc of the first metal oxide particles, and the refractive index of Rh of the second metal oxide particles, each for light having a wavelength of 780 nm, satisfy the following relationships:

$$|Rb-Rc|\leq 0.35; \text{ and}$$

$$|Rb-Rh|\geq 0.65.$$

The electroconductive layer has a volume resistivity of $1.0\times10^{6}$ Ω·cm to $1.0\times10^{13}$ Ω·cm, and the ratio Sc/Sh of the specific gravity Sc of the first metal oxide particles to the specific gravity Sh of the second metal oxide particles is from 0.85 to 1.20.

According to another aspect, there is provided a process cartridge capable of being removably attached to an electrophotographic apparatus. The process cartridge includes the electrophotographic photosensitive member and at least one device selected from the group consisting of a charging device, a developing device, a transfer device, and a cleaning device. The electrophotographic photosensitive member and the at least one device are held in one body.

Also, an electrophotographic apparatus is provided which includes the above-described electrophotographic photosensitive member, a charging device, an exposure device, a developing device, and a transfer device.

Further features of the present disclosure will become apparent from the following description of exemplary embodiments with reference to the attached drawings.

DESCRIPTION OF THE EMBODIMENTS

Figure 1:
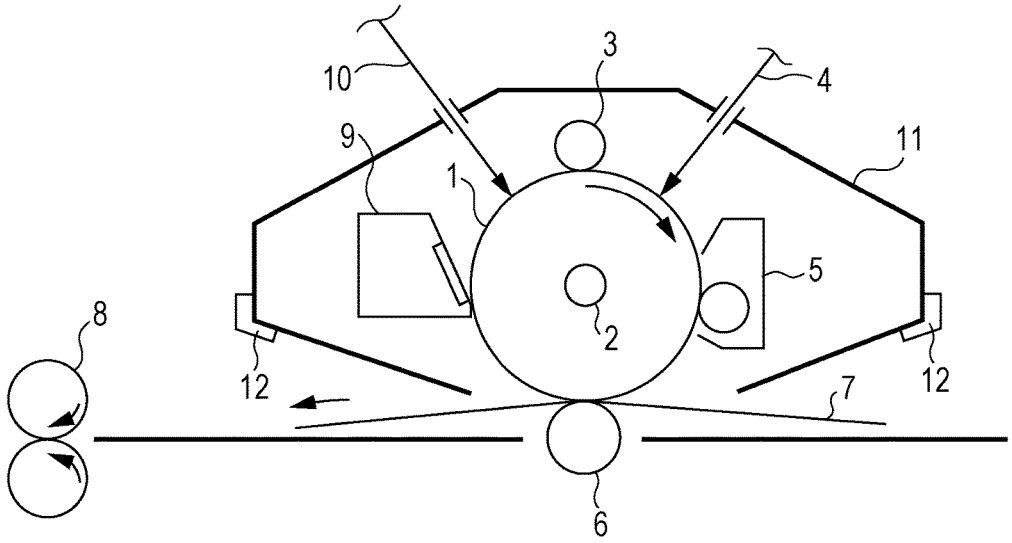
FIG. 1 is a schematic view of the structure of an electrophotographic apparatus provided with a process cartridge including an electrophotographic photosensitive member.

The present inventors found that while the electrophotographic photosensitive member disclosed in the above-cited Japanese Patent Laid-Open No. 2009-58789 favorably hid defects at the surface of the support member, the potential of the electrophotographic photosensitive member varied at dark and bright portions when repeatedly used. Accordingly, the present disclosure provides an electrophotographic photosensitive member that enables can reduce the variation in potential accompanying repeated use while hiding defects at the surface of the support member.

The subject matter of the present disclosure will be described in detail in the following exemplary embodiments.

The present inventors found through their studies that the electrophotographic photosensitive member including an electroconductive layer described as below can favorably hide defects at the surface of the support member and reduce the variation in potential accompanying repeated use. The electroconductive layer contains a binder resin, electrically conductive first metal oxide particles, and second metal oxide particles and satisfies the following conditions:

the refractive indices Rb, Rc, and Rh of the binder resin, the first metal oxide particles, and the second metal oxide particles, respectively, for light having a wavelength of 780 nm satisfy the following relationships:

$$|Rb-Rc|\leq 0.35 \text{ and}$$

$$|Rb-Rh|\geq 0.65; \text{ and}$$

the volume resistivity of the electroconductive layer of the electroconductive layer is $1.0\times10^{6}$ Ω·cm to $1.0\times10^{13}$ Ω·cm, and the ratio Sc/Sh of the specific gravity Sc of the first metal oxide particles to the specific gravity Sh of the second metal oxide particles is 0.85 to 1.20 ($0.85\leq Sc/Sh\leq 1.20$ (1)).

First, the present inventors found that a combined use of a binder resin, first electrically conductive metal oxide particles, and second metal oxide particles that satisfy the relationships $|Rb-Rc| \leq 0.35$ and $|Rb-Rh| \geq 0.65$ facilitates the increase in optical opacity of the electroconductive layer.

The present inventors also found that the variation in potential at dark and bright portions accompanying repeated use can be reduced by controlling the volume resistivity of the electroconductive layer to $1.0 \times 10^6$ Ω·cm to $1.0 \times 10^{13}$ Ω·cm.

However, in spite of satisfying all those conditions, the electroconductive layer does still not have an opacity that can satisfactorily hide defects at the surface of the support member while reducing the variation in potential accompanying repeated use to the level as intended.

The present inventors finally found through their studies that the two types of metal oxide particles are required to have specific gravities satisfying the above-mentioned relationship (1). The reason for this is probably explained by the following mechanism.

If the electroconductive layer contains plural types of metal oxide particles having different specific gravities, the distribution of the metal oxide particles probably varies in the electroconductive layer depending on the material that forms the metal oxide particles, and the particles are not uniformly distributed. Such a non-uniform distribution of the metal oxide particles is likely to cause retention of charges in the electroconductive layer. Some results of the studies by the present inventors suggest that by controlling the ratio (Sc/Sh) of the specific gravities of the two type of metal oxide particles in a specific range (from 0.85 to 1.20), the non-uniform distribution can be suppressed; hence, the two types of metal oxide particles can be uniformly distributed. The present inventors believe that the electroconductive layer thus becomes unlikely to retain charges, and that consequently, the variation in potential at dark and bright portions accompanying repeated use can be reduced.

Accordingly, by selecting metal oxide particles of different types satisfying relationship (1), the electrophotographic photosensitive member of the present disclosure can be achieved. For example, when the first metal oxide particles are tin oxide-coated barium sulfate particles and the second metal oxide particles are particles of at least one metal oxide selected from the group consisting of strontium titanate, barium titanate, and niobium oxide, the above-described relationships are satisfied.

Electrophotographic Photosensitive Member

The electrophotographic photosensitive member disclosed herein includes a support member, an electroconductive layer, and a photosensitive layer, in this order.

The electrophotographic photosensitive member may be manufactured by applying each of the coating liquids prepared for forming the respective layers, which will be described later, in a desired order, and drying the coatings. Each coating liquid may be applied by dip coating, spray coating, ink jet coating, roll coating, die coating, blade coating, curtain coating, wire bar coating, ring coating, or any other method. In some embodiments, dip coating may be employed from the viewpoint of efficiency and productivity. The layers of the electrophotographic photosensitive member will now be described.

Support Member

The electrophotographic photosensitive member disclosed herein includes a support member. Beneficially, the support member is electrically conductive. The support member may be in the form of a cylinder, a belt, a sheet, or the like. In at least some embodiments, A hollow cylindrical support member is used. The support member may be surface-treated by electrochemical treatment, such as anodization, or blasting, centerless polishing, or cutting.

In some embodiment, the support member may be made of a metal, a resin, or glass.

For a metal support member, the metal may be selected from among aluminum, iron, nickel, copper, gold, stainless steel, and alloys thereof. An aluminum support member is beneficial.

If the support member is made of a resin or glass, an electrically conductive material may be added into or applied over the support member to impart an electrical conductivity.

Electroconductive Layer

The electroconductive layer of the electrophotographic photosensitive member disclosed herein is disposed over the support member and contains a binder, first metal oxide particles, and second metal oxide particles. The electroconductive layer covers the surface flaw or surface roughness of the support member and reduces the reflection of light from the surface of the support member.

The first metal oxide particles are electrically conductive. Examples of the metal oxide of the first metal oxide particles include zinc oxide, aluminum oxide, indium oxide, silicon oxide, zirconium oxide, tin oxide, titanium oxide, magnesium oxide, antimony oxide, and bismuth oxide. In at least some embodiments, titanium oxide, tin oxide, or zinc oxide may be used.

The first metal oxide particles may be surface-treated with a silane coupling agent or the like or doped with an element such as phosphorus or aluminum or oxide thereof.

The first metal oxide particle may include a core particle and a coating layer coating the core particle. The core particle may be made of titanium oxide, barium sulfate, zinc oxide, or the like. The coating layer may be made of a metal oxide, such as tin oxide. In at least some embodiments, the first metal oxide particles may be tin oxide-coated barium sulfate particles.

Examples of the metal oxide of the second metal oxide particles include zinc oxide, aluminum oxide, indium oxide, silicon oxide, zirconium oxide, tin oxide, titanium oxide, magnesium oxide, antimony oxide, bismuth oxide, barium titanate, strontium titanate, niobium oxide, and niobium hydroxide. In at least some embodiments, barium titanate, strontium titanate, niobium oxide, or niobium hydroxide may be used. Barium titanate, strontium titanate, and niobium oxide may be beneficial. The use of particles of barium titanate, strontium titanate, or niobium oxide as the second metal oxide particles helps the electroconductive layer to hide surface defects at the support member and facilitates reducing variation in potential at dark and bright portions accompanying repeated use.

In at least some embodiments, the first and the second metal oxide particles have an average primary particle size of 50 nm to 500 nm. Particles having an average primary particle size of 50 nm or more are unlikely to aggregate in the coating liquid prepared for forming the electroconductive layer (hereinafter may be referred to as electroconductive layer-forming coating liquid). Aggregates of the particles in the electroconductive layer-forming coating liquid reduce the stability of the coating liquid and cause the resulting electroconductive layer to crack in the surface thereof. When particles having an average primary particle size of 500 nm or less are used, the surface of the resulting electroconductive layer is unlikely to become rough. A rough surface of the electroconductive layer easily allow charges to be locally injected into the photosensitive layer. Consequently, black spots are likely to become noticeable in a white or blank area in the output image. In at least some embodiments, the average primary particle size of the particles is 100 nm to 400 nm.

The first and the second metal oxide particles may be spherical, polyhedral, elliptical, flaky, needle-like, or the like. In some embodiments, the particles are spherical, polyhedral, or elliptical from the viewpoint of reducing image defects such as black spots. In at least some embodiments, the first metal oxide particles have a spherical shape or a polyhedral shape close to a sphere.

The binder contained in the electroconductive layer of the present disclosure may be of polyester resin, polycarbonate resin, polyvinyl acetal resin, acrylic resin, silicone resin, epoxy resin, melamine resin, polyurethane resin, phenol resin, or alkyd resin.

In some embodiments, the binder may be of a thermosetting phenol resin or a thermosetting polyurethane resin. When a thermosetting resin is used as the binder, the binder added in the electroconductive layer-forming coating liquid is in the form of a monomer and/or an oligomer of the thermosetting resin.

The electroconductive layer may further contain silicone oil, resin particles, or the like.

The average thickness of the electroconductive layer may be 0.5 μm to 50 μm, for example, 1 μm to 40 μm or 5 μm to 35 μm.

In the present disclosure, the volume resistivity of the electroconductive layer is $1.0\times10^{6}$ Ω·cm to $1.0\times10^{13}$ Ω·cm. The electroconductive layer having a volume resistivity of $1.0\times10^{13}$ Ω·cm or less can help charges to flow smoothly and suppress increase in residual potential and the variation in potential at dark and bright portions when imagery is formed. Also, the electroconductive layer having a volume resistivity of $1.0\times10^{6}$ Ω·cm or more can suppress excessive flow of charges in the electroconductive layer and leakage in the electrophotographic photosensitive member when the electrophotographic photosensitive member is charged. In some embodiments, the volume resistivity of the electroconductive layer may be $1.0\times10^{8}$ Ω·cm to $1.0\times10^{12}$ Ω·cm.

Figure 2:
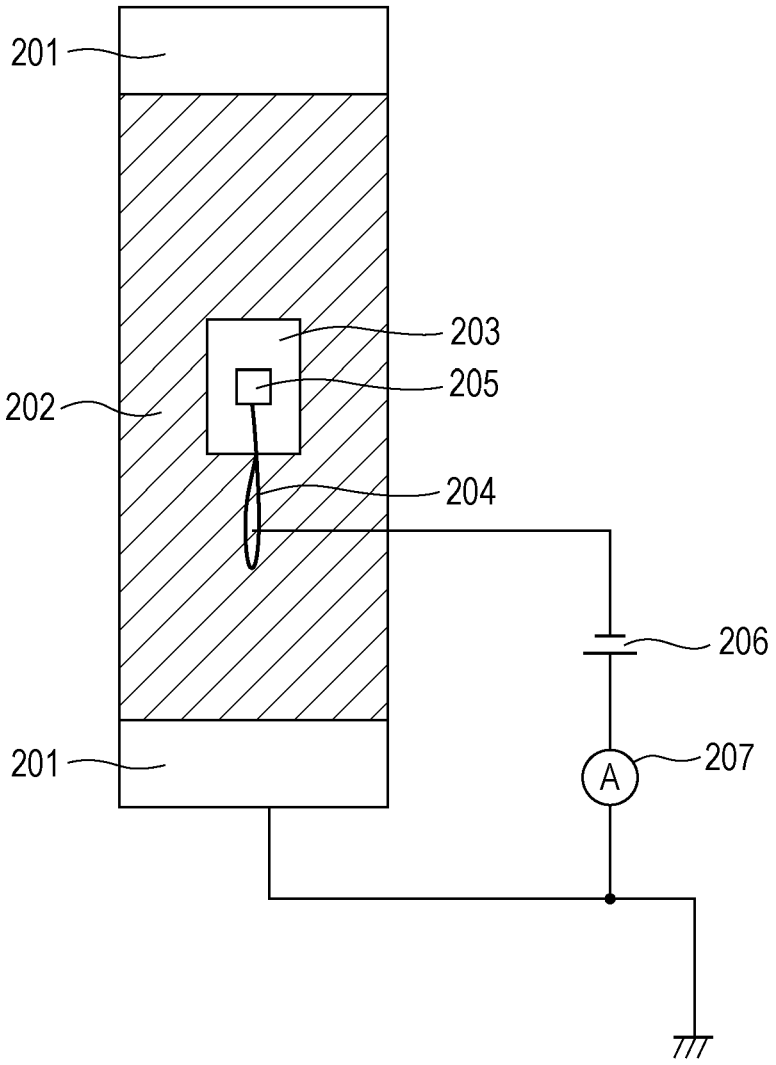
FIG. 2 is a top view of an electroconductive layer, illustrating a method for measuring the volume resistivity of the electroconductive layer.
Figure 3:
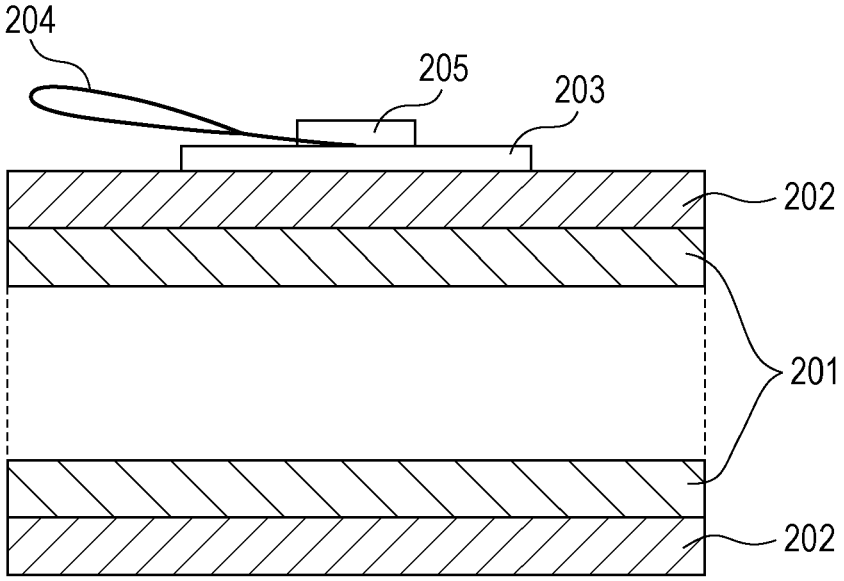
FIG. 3 is a sectional view of an electroconductive layer, illustrating a method for measuring the volume resistivity of the electroconductive layer.

A method for measuring the volume resistivity of the electrophotographic photosensitive member will be described with reference to FIGS. 2 and 3. FIG. 2 is a top view of an electroconductive layer, illustrating a method for measuring the volume resistivity of the electroconductive layer, and FIG. 3 is a sectional view of the electroconductive layer, illustrating the method.

The volume resistivity of the electroconductive layer is measured at normal temperature and normal humidity (temperature: 23° C., relative humidity: 50%). A copper tape 203 (product code No. 1181, manufactured by 3M) is stuck to the surface of the electroconductive layer 202. This tape is used as the front electrode of the electroconductive layer 202. The support member 201 is used as the rear electrode of the electroconductive layer 202. A power supply 206 from which a voltage is applied between the copper tape 203 and the support member 201 and a current measuring device 207 for measuring the current flowing between the copper tape 203 and the support member 201 are provided. For applying a voltage to the copper tape 203, a copper wire 204 is put on the copper tape 203 and fixed so as not to come off from the copper tape 203 by sticking another copper tape 205 onto the copper tape 203. A voltage is applied to the copper tape 203 through the copper wire 204.

The volume resistivity ρ (Ω·cm) of the electroconductive layer 202 is defined by the equation: $\rho=1/(I-I_0)\times S/d$, wherein $I_0$ (A) represents the background current when no current is applied between the copper tape 203 and the support member 201, I (A) represents the current when only a direct voltage (direct component) of −1 V is applied between the copper tape 203 and the support member 201, d (cm) represents the thickness of the electroconductive layer 202, and S ($cm^2$) represents the area of the front electrode or copper tape 203 on the front side of the electroconductive layer 202. Beneficially, the current measuring device 207 used for this measurement is able to measure very small current. In this measurement, a current as small as $1\times10^{-6}$ A or less in terms of absolute value is measured. Such a current measuring device may be, for example, pA meter 4140B manufactured by Hewlett-Packard. The volume resistivity of the electroconductive layer may be measured in a state where only the electroconductive layer is formed on the support member, or in a state where only the electroconductive layer is left after the overlying layers (including the photosensitive layer) have been removed from the electrophotographic photosensitive member. Either case obtains the same measurement value.

The powder of the first metal oxide particles may have a resistivity (powder resistivity) of 1.0 Ω·cm to $1.0\times10^{6}$ Ω·cm. When the powder resistivity is in this range, the electroconductive layer is likely to have a volume resistivity in the above-described range. In some embodiments, the powder resistivity of particles may be $1.0\times10^{2}$ Ω·cm to 1.0×104 Ω·cm. In the present disclosure, the powder resistivity of the particles is measured at normal temperature and normal humidity (temperature: 23° C., relative humidity: 50%). Powder resistivity mentioned herein is the value measured with a resistivity meter Loresta GP manufactured by Mitsubishi Chemical Analytech. For this measurement, particles to be measured are pressed into a pellet at a pressure of 500 $kg/cm^2$, and the pellet is measured at an applied voltage of 100 V.

In some embodiments, the first metal oxide particle content in the electroconductive layer may be 15% by volume to 40% by volume relative to the total volume of the electroconductive layer. When the first metal oxide particle content is in this range, the electroconductive layer is likely to have a desired volume resistivity, and the variation in potential at dark and bright portions accompanying repeated use can be reduced.

In some embodiments, the ratio of the first metal oxide particle content to the second metal oxide particle content in the electroconductive layer may be from 1:1 to 4:1 in terms of volume. When the first and the second metal oxide particles are contained in such a ratio, the electroconductive layer is likely to have a desired volume resistivity, and the variation in potential at dark and bright portions accompanying repeated use can be reduced.

The electroconductive layer may be formed by applying an electroconductive layer-forming coating liquid containing the above-described constituents and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon. The metal oxide particles are dispersed in the coating liquid by using, for example, a paint shaker, a sand mill, a ball mill, or a high-speed liquid collision disperser. The thus prepared coating liquid may be filtered to remove unnecessary impurities.

Undercoat Layer

The electrophotographic photosensitive member may include an undercoat layer on the electroconductive layer. The undercoat layer enhances the adhesion between layers and blocks charge injection.

The undercoat layer may contain a resin. The undercoat layer may be a cured film formed by polymerizing a composition containing a monomer having a polymerizable functional group.

Examples of the resin contained in the undercoat layer include polyester resin, polycarbonate resin, polyvinyl acetal resin, acrylic resin, epoxy resin, melamine resin, polyurethane resin, phenol resin, polyvinylphenol resin, alkyd resin, polyvinyl alcohol resin, polyethylene oxide resin, polypropylene oxide resin, polyamide resin, polyamide acid resin, polyimide resin, poly(amide-imide) resin, and cellulose resin.

Examples of the polymerizable functional group of the monomer include an isocyanate group, blocked isocyanate groups, a methylol group, alkylated methylol groups, an epoxy group, metal alkoxide groups, a hydroxyl group, an amino group, a carboxy group, a thiol group, a carboxy anhydride group, and a carbon-carbon double bond.

The undercoat layer may further contain an electron transporting material, a metal oxide, a metal, or an electrically conductive polymer from the viewpoint of increasing the electrical properties. In some embodiments, an electron transporting material or a metal oxide may be used.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The electron transporting material may have a polymerizable functional group so that the undercoat layer can be formed as a cured film by copolymerizing the electron transporting material and the above-described monomer having a polymerizable functional group.

Examples of the metal oxide added to the undercoat layer include indium tin oxide, tin oxide, indium oxide, titanium oxide, zinc oxide, aluminum oxide, and silicon dioxide. The metal added to the undercoat layer may be gold, silver, or aluminum.

The undercoat layer may further contain an additive.

The average thickness of the undercoat layer may be 0.1 μm to 50 μm, for example, 0.2 μm to 40 μm or 0.3 μm to 30 μm.

The undercoat layer may be formed by applying an undercoat layer-forming coating liquid containing the above-described constituents and a solvent to form a coating film, followed by drying and/or curing. The solvent of the undercoat layer-forming coating liquid may be an alcohol-based solvent, a ketone-based solvent, an ether-based solvent, an ester-based solvent, or an aromatic hydrocarbon.

Photosensitive Layer

The photosensitive layer of the electrophotographic photosensitive member may be: (1) a multilayer photosensitive layer; or (2) a single-layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting material together.

(1) Multilayer Photosensitive Layer

The multilayer photosensitive layer includes a charge generating layer and a charge transport layer.

(1-1) Charge Generating Layer

The charge generating layer may contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are beneficial. In some embodiments, an oxytitanium phthalocyanine pigment, a chlorogallium phthalocyanine pigment, or a hydroxygallium phthalocyanine pigment may be used as the phthalocyanine pigment.

The charge generating material content in the charge generating layer may be 40% by mass to 85% by mass, for example, 60% by mass to 80% by mass, relative to the total mass of the charge generating layer.

Examples of the resin contained in the charge generating layer include polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, and polyvinyl chloride resin. Among these, polyvinyl butyral resin is beneficial.

The charge generating layer may further contain an antioxidant, a UV absorbent, or any other additive. Examples of such an additive include hindered phenol compounds, hindered amine compounds, sulfur compounds, phosphorus compounds, and benzophenone compounds.

The average thickness of the charge generating layer may be 0.1 μm to 1 μm, for example, 0.15 μm to 0.4 μm.

The charge generating layer may be formed by applying a coating liquid containing the above-described constituents and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon.

(1-2) Charge Transport Layer

The charge transport layer may contain a charge transporting material and a resin.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. In some embodiments, a triarylamine compound or a benzidine compound may be used.

The charge transporting material content in the charge transport layer may be 25% by mass to 70% by mass, for example, 30% by mass to 55% by mass, relative to the total mass of the charge transport layer.

The resin contained in the charge transport layer may be a polyester resin, a polycarbonate resin, an acrylic resin, or a polystyrene resin. In some embodiments, a polycarbonate resin or a polyester resin may be used. If a polyester resin is used, a polyarylate resin is beneficial.

The mass ratio of the charge transporting material to the resin may be 4:10 to 20:10, for example, 5:10 to 12:10.

The charge transport layer may further contain one or some additives, such as an antioxidant, a UV absorbent, a plasticizer, a leveling agent, a lubricant, and an abrasion resistance improver. More specifically, exemplary additives include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the charge transport layer may be 5 μm to 50 μm, for example, 8 μm to 40 μm or 9 μm to 30 μm.

The charge transport layer may be formed by applying a charge transport layer-forming coating liquid containing the above-described constituents and a solvent to form a coating film, followed by drying. The solvent of the charge transport layer-forming coating liquid may be an alcohol-based solvent, a ketone-based solvent, an ether-based solvent, an ester-based solvent, or an aromatic hydrocarbon. In some embodiments, an ether-based solvent or an aromatic hydrocarbon may be used as the solvent.

(2) Single-Layer Photosensitive Layer

The single-layer photosensitive layer may be formed by applying a coating liquid containing a charge generating material, a charge transporting material, a resin, and a solvent to form a coating film, followed by drying. The charge generating material, the charge transporting material, and the resin may be selected from among the same materials cited in "(1) Multilayer Photosensitive Layer".

Protective Layer

The photosensitive layer may be covered with a protective layer. The protective layer enhances durability.

The protective layer may contain electrically conductive particles and/or a charge transporting material and a resin.

The electrically conductive particles may be those of a metal oxide, such as titanium oxide, zinc oxide, tin oxide, or indium oxide.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. In some embodiments, a triarylamine compound or a benzidine compound may be used.

Examples of the resin contained in the protective layer include polyester resin, acrylic resin, phenoxy resin, polycarbonate resin, polystyrene resin, phenol resin, melamine resin, and epoxy resin. In some embodiments, a polycarbonate resin, a polyester resin, or an acrylic resin may be used.

The protective layer may be a cured film formed by polymerizing a composition containing a monomer having a polymerizable functional group. In this instance, a thermal polymerization reaction, a photopolymerization reaction, a radiation polymerization reaction, or the like may be conducted. The polymerizable functional group of the monomer may be an acryloyl group or a methacryloyl group. The monomer having a polymerizable functional group may have a charge transporting function.

The protective layer may further contain one or some additives, such as an antioxidant, a UV absorbent, a plasticizer, a leveling agent, a lubricant, and an abrasion resistance improver. More specifically, exemplary additives include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the protective layer may be 0.5 μm to 10 μm, for example, 1 μm to 7 μm.

The protective layer may be formed by applying a coating liquid for the protective layer containing the above-described constituents and a solvent to form a coating film, followed by drying and/or curing. The solvent of the coating liquid for the protective layer may be an alcohol-based solvent, a ketone-based solvent, an ether-based solvent, a sulfoxide-based solvent, an ester-based solvent, or an aromatic hydrocarbon.

Process Cartridge and Electrophotographic Apparatus

The process cartridge according to an embodiment of the present disclosure is removably mounted in an electrophotographic apparatus and includes the above-described electrophotographic photosensitive member and at least one device selected from the group consisting of a charging device, a developing device, a transfer device, and a cleaning device. The electrophotographic photosensitive member and these devices are held in one body.

Also, the electrophotographic apparatus according to an embodiment of the present disclosure includes the above-described electrophotographic photosensitive member, a charging device, an exposure device, a developing device, and a transfer device.

FIG. 1 is a schematic view of the structure of an electrophotographic apparatus provided with a process cartridge including an electrophotographic photosensitive member.

The electrophotographic photosensitive member designated by reference numeral 1 is cylindrical and is driven for rotation on a shaft 2 in the direction indicated by an arrow at a predetermined peripheral speed. The surface of the electrophotographic photosensitive member 1 is charged to a predetermined positive or negative potential with a charging device 3. Although the charging device 3 shown in FIG. 1 is of a type for roller charging with a charging member in the shape of a roller, the charging device may be a type for corona charging, proximity charging, injection charging, or the like. An electrostatic latent image corresponding to targeted image information is formed on the surface of the charged electrophotographic photosensitive member 1 by irradiation with exposure light 4 from an exposure device (not shown). The electrostatic latent image formed on the surface of the electrophotographic photosensitive member 1 is developed into a toner image with a toner contained in a developing device 5. The toner image on the surface of the electrophotographic photosensitive member 1 is transferred to a transfer medium 7 by a transfer device 6. The transfer medium 7 to which the toner image has been transferred is conveyed to a fixing device 8 and fixed by the fixing device 8, thus being ejected as an output image from the electrophotographic apparatus. The electrophotographic apparatus may include a cleaning device 9 for removing toner or the like remaining on the electrophotographic photosensitive member 1 after transfer. Alternatively, what is called a cleanerless system in which the developing device or the like acts to remove the toner or the like may be implemented without using a cleaning device. The electrophotographic apparatus may include a static elimination mechanism operable to remove static electricity from the surface of the electrophotographic photosensitive member 1 with pre-exposure light 10 from a pre-exposure device (not shown). Also, the electrophotographic apparatus may have a guide 12, such as a rail, that guides the removal or attachment of the process cartridge.

The electrophotographic photosensitive member of the present disclosure may be used in a laser beam printer, an LED printer, a copy machine, a facsimile, or a multifunctional machine having functions of those apparatuses.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Electroconductive Layer-Forming Coating Liquids

Electroconductive Layer-Forming Coating Liquid 1

A mixture of the following materials was prepared: 80 parts of tin oxide-coated barium sulfate particles (PASTRAN PC1, produced by Mitsui Mining & Smelting, powder resistivity: 50 Ω·cm, specific gravity: 5.2, refractive index: 1.8) as the first metal oxide particles; 20 parts of niobium oxide particles (NSS, produced by Mitsui Mining & Smelting, specific gravity: 4.5, refractive index: 2.3, average primary particle size: 250 nm) as the second metal oxide particles; 65 parts of a phenol resin (phenol resin monomer/oligomer) Plyophen J-325 (produced by DIC, resin solids content: 60%, density after being cured: 1.3 g/cm$^2$) as the binder resin; and 70 parts of 1-methoxy-2-propanol as the solvent. The refractive index of a cured film composed of the binder resin is 1.6.

The mixture was agitated in a vertical sand mill with 200 parts of glass beads of 1.0 mm in average diameter at a dispersion temperature of 23° C.±3° C. and a rotational speed of 2000 rpm (peripheral speed of 7.3 m/s) for 4 hours to yield a dispersion liquid. The glass beads were removed from the resulting dispersion liquid by using a mesh.

Then, 0.014 part of silicone oil SH28 PAINT ADDITIVE (produced by Dow Corning Toray) as a leveling agent and 14 parts of silicone resin particles Tospearl 120 (produced by Momentive Performance Materials, average particle size: 2 μm, density: 1.3 g/cm$^2$) as a surface roughness agent were added into the dispersion liquid, followed by stirring. The mixture was subjected to pressure filtration through a PTFE filter PF060 (manufactured by ADVANTEC) to yield electroconductive layer-forming coating liquid 1.

Electroconductive Layer-Forming Coating Liquids 2 to 4, 6 to 11, C1, C2, and C4 to C9

Electroconductive layer-forming coating liquids were prepared in the same manner as electroconductive layer-forming coating liquid 1 except that the first and the second metal oxide particles and the proportions (parts) thereof were changed as shown in Table 1. The second metal oxide particles used were as follows:

- strontium titanate particles (ST-03 produced by Sakai Chemical Industry, specific gravity: 5.1, refractive index: 2.4, average primary particle size: 200 nm)
- barium titanate particles (BT-HP9DX produced by KCM Corporation, specific gravity: 6.1, refractive index: 2.4, average primary particle size: 200 nm)
- titanium oxide (TITANIX JR produced by Tayca, specific gravity: 4.2, refractive index: 2.7, rutile type, average primary particle size: 270 nm)

Electroconductive Layer-Forming Coating Liquid C3

This coating liquid was prepared in the same manner as electroconductive layer-forming coating liquid C1, except for using tin oxide-coated barium sulfate particles having a powder resistivity of $1\times10^3$ Ω·cm as the first metal oxide particles and agitating the mixture for 10 hours for dispersion.

Electroconductive Layer-Forming Coating Liquid 5

This coating liquid was prepared in the same manner as electroconductive layer-forming coating liquid 1, except for using tin oxide-coated barium sulfate particles having a powder resistivity of $1\times10^3$ Ω·cm as the first metal oxide particles and agitating the mixture for 10 hours for dispersion.

Electroconductive Layer-Forming Coating Liquid 12

A mixture was prepared by dissolving the following materials in a solvent being a mixed solvent of 50 parts of methyl ethyl ketone and 70 parts of 1-butanol: 80 parts of tin oxide-coated barium sulfate particles (PASTRAN PC1, produced by Mitsui Mining & Smelting, powder resistivity: 50 Ω·cm, specific gravity: 5.2, refractive index: 1.8) as the first metal oxide particles; 20 parts of niobium oxide particles (NSS, produced by Mitsui Mining & Smelting, specific gravity: 4.5, refractive index: 2.3, average primary particle size: 250 nm) as the second metal oxide particles; and a binder resin being 20 parts of a butyral resin (BM-1 produced by Sekisui Chemical) and 20 parts of blocked isocyanate resin (TPA-B80E produced by Asahi Kasei, 80% solution). The refractive index of a cured film composed of the binder resin is 1.5.

The mixture was agitated in a vertical sand mill with 120 parts of glass beads of 1.0 mm in average diameter at a dispersion temperature of 23° C.±3° C. and a rotational speed of 2000 rpm (peripheral speed of 7.3 m/s) for 4 hours to yield a dispersion liquid. The glass beads were removed from the resulting dispersion liquid by using a mesh.

Then, 0.014 part of silicone oil SH28 PAINT ADDITIVE (produced by Dow Corning Toray) as a leveling agent and 7 parts of crosslinked polymethyl methacrylate (PMMA) particles Techpolymer SSX-102 (produced by Sekisui Plastics, average primary particle size: 2.5 μm) as a surface roughness agent were added into the dispersion liquid, followed by stirring. The mixture was subjected to pressure filtration through a PTFE filter PF060 (manufactured by ADVANTEC) to yield an electroconductive layer-forming coating liquid.

Electroconductive Layer-Forming Coating Liquid C10

This coating liquid was prepared in the same manner as electroconductive layer-forming coating liquid 12 except that the second metal oxide particles were replaced with titanium oxide particles.

Electroconductive Layer-Forming Coating Liquid 13

A mixture was prepared by dissolving the following materials in a solvent being 70 parts of methyl ethyl ketone: 80 parts of tin oxide-coated barium sulfate particles (PASTRAN PC1, produced by Mitsui Mining & Smelting, powder resistivity: 50 Ω·cm, specific gravity: 5.2, refractive index: 1.8) as the first metal oxide particles; 20 parts of niobium oxide particles (NSS, produced by Mitsui Mining & Smelting, specific gravity: 4.5, refractive index: 2.3, average primary particle size: 250 nm) as the second metal oxide particles; and a binder resin being 35 parts by mass of an alkyd resin (BECKOLITE M6401 produced by DIC, solids content: 55%) and 15 parts of a melamine resin (Super Beckamine G-821 produced by DIC, solids content: 65%). The refractive index of a cured film composed of the binder resin is 1.6.

The mixture was agitated in a vertical sand mill with 200 parts of glass beads of 1.0 mm in average diameter at a dispersion temperature of 23° C.±3° C. and a rotational speed of 2000 rpm (peripheral speed of 7.3 m/s) for 4 hours to yield a dispersion liquid. The glass beads were removed from the resulting dispersion liquid by using a mesh.

Then, 0.014 part of silicone oil SH28 PAINT ADDITIVE (produced by Dow Corning Toray) as a leveling agent and 14 parts of silicone resin particles Tospearl 120 (produced by Momentive Performance Materials, average particle size: 2 μm, density: 1.3 g/cm$^2$) as a surface roughness agent were added into the dispersion liquid, followed by stirring. The mixture was subjected to pressure filtration through a PTFE filter PF060 (manufactured by ADVANTEC) to yield an electroconductive layer-forming coating liquid.

Electroconductive Layer-Forming Coating Liquid C11

This coating liquid was prepared in the same manner as electroconductive layer-forming coating liquid 13 except that the second metal oxide particles were replaced with titanium oxide particles.

Electroconductive Layer-Forming Coating Liquid C12

This coating liquid was prepared in the same manner as electroconductive layer-forming coating liquid 4, except for agitating the mixture for 20 hours for dispersion.

Electroconductive Layer-Forming Coating Liquid C13

This coating liquid was prepared in the same manner as electroconductive layer-forming coating liquid 1 except that the second metal oxide particles were not added.

TABLE 1

Compositions and Properties of Electroconductive Layer-Forming Coating Liquids

| Coating liquid | First metal oxide particles | | Second metal oxide particles | | Binder resin | Difference in refractive index | | Specific gravity |
|---|---|---|---|---|---|---|---|---|
| No. | Parts | Powder resistivity (Ω cm) | Metal oxide | Parts | Resin | \|Rb − Rc\| | \|Rb − Rh\| | Sc/Sh |
| 1 | 80 | 50 | Niobium oxide | 20 | Phenol resin | 0.2 | 0.7 | 1.16 |
| 2 | 80 | 50 | Strontium titanate | 20 | Phenol resin | 0.2 | 0.8 | 1.02 |
| 3 | 80 | 50 | Barium titanate | 20 | Phenol resin | 0.2 | 0.8 | 0.85 |
| 4 | 80 | $1.0 \times 10^3$ | Niobium oxide | 20 | Phenol resin | 0.2 | 0.7 | 1.16 |
| 5 | 80 | $1.0 \times 10^3$ | Niobium oxide | 20 | Phenol resin | 0.2 | 0.7 | 1.16 |
| 6 | 40 | 50 | Niobium oxide | 20 | Phenol resin | 0.2 | 0.7 | 1.16 |
| 7 | 30 | 50 | Niobium oxide | 20 | Phenol resin | 0.2 | 0.7 | 1.16 |
| 8 | 40 | 50 | Niobium oxide | 40 | Phenol resin | 0.2 | 0.7 | 1.16 |
| 9 | 100 | 50 | Niobium oxide | 20 | Phenol resin | 0.2 | 0.7 | 1.16 |
| 10 | 120 | 50 | Niobium oxide | 20 | Phenol resin | 0.2 | 0.7 | 1.16 |
| 11 | 140 | 50 | Niobium oxide | 20 | Phenol resin | 0.2 | 0.7 | 1.16 |
| 12 | 80 | 50 | Niobium oxide | 20 | Urethane resin | 0.3 | 0.8 | 1.16 |
| 13 | 80 | 50 | Niobium oxide | 20 | Alkyd resin/ melamine resin | 0.2 | 0.7 | 1.16 |
| C1 | 80 | 50 | Titanium oxide | 20 | Phenol resin | 0.2 | 1.1 | 1.24 |
| C2 | 80 | $1.0 \times 10^3$ | Titanium oxide | 20 | Phenol resin | 0.2 | 1.1 | 1.24 |
| C3 | 80 | $1.0 \times 10^3$ | Titanium oxide | 20 | Phenol resin | 0.2 | 1.1 | 1.24 |
| C4 | 40 | 50 | Titanium oxide | 20 | Phenol resin | 0.2 | 1.1 | 1.24 |
| C5 | 30 | 50 | Titanium oxide | 20 | Phenol resin | 0.2 | 1.1 | 1.24 |
| C6 | 40 | 50 | Titanium oxide | 40 | Phenol resin | 0.2 | 1.1 | 1.24 |
| C7 | 100 | 50 | Titanium oxide | 20 | Phenol resin | 0.2 | 1.1 | 1.24 |
| C8 | 120 | 50 | Titanium oxide | 20 | Phenol resin | 0.2 | 1.1 | 1.24 |
| C9 | 140 | 50 | Titanium oxide | 20 | Phenol resin | 0.2 | 1.1 | 1.24 |
| C10 | 80 | 50 | Titanium oxide | 20 | Urethane resin | 0.2 | 1.2 | 1.24 |
| C11 | 80 | 50 | Titanium oxide | 20 | Alkyd resin/ melamine resin | 0.2 | 1.1 | 1.24 |
| C12 | 80 | $1.0 \times 10^3$ | Niobium oxide | 20 | Phenol resin | 0.2 | 0.7 | 1.16 |
| C13 | 80 | 50 | — | — | Phenol resin | 0.2 | — | — |

Preparation of Electrophotographic Photosensitive Members

Electrophotographic Photosensitive Member 1

An aluminum (aluminum alloy, JIS A3003) cylinder of 257 mm in length and 24 mm in diameter manufactured in a process including extrusion and drawing was used as a support member.

Electroconductive layer-forming coating liquid 1 was applied onto the surface of the support member by dip coating at normal temperature and normal humidity (23° C. and 50% RH). The resulting coating film was dried and cured by heating at 150° C. for 30 minutes to yield a 30 μm-thick electroconductive layer. The volume resistivity of the electroconductive layer was $1\times10^{10}$ Ω·cm.

Subsequently, 4.5 parts of N-methoxymethylated nylon resin Tresin EF-30T (produced by Nagase Chemtex) and 1.5 parts of a copolymerized nylon resin Amilan CM8000 (produced by Toray) were dissolved in a mixed solvent of 65 parts of methanol and 30 parts of n-butanol to yield an undercoat layer-forming coating liquid. The undercoat layer-forming coating liquid was applied onto the surface of the electroconductive layer by dip coating. The resulting coating film was dried at 70° C. for 6 minutes to yield a 0.8 μm-thick undercoat layer.

Subsequently, 10 parts of a crystalline hydroxygallium phthalocyanine (charge generating material) whose CuKα X-ray diffraction spectrum has peaks at Bragg angles 2θ(±0.2°) of 7.5°, 9.9°, 16.3°, 18.6°, 25.1°, and 28.3°, 5 parts of polyvinyl butyral S-LEC BX-1 (produced by Sekisui Chemical), and 250 parts of cyclohexanone were added into a sand mill containing glass beads of 0.8 mm in diameter. The contents in the sand mill were dispersed in each other for 3 hours. Into the resulting dispersion was added 250 parts of ethyl acetate to yield a coating liquid for forming a charge generating layer. This coating liquid was applied onto the undercoat layer by dip coating. The resulting coating film was dried at 100° C. for 10 minutes to yield a 0.15 μm-thick charge generating layer.

Then, a coating liquid for forming a charge transport layer was prepared by dissolving 6.0 parts of the amine compound (charge transporting material) represented by the following formula (CT-1), 2.0 parts of the amine compound (charge transporting material) represented by the following formula (CT-2), 10 parts of bisphenol Z polycarbonate Z400 (produced by Mitsubishi Engineering-Plastics), and 0.36 part of siloxane-modified polycarbonate having a repeating unit represented by the following formula (B-1) and a repeating unit represented by the following formula (B-2) with a mole ratio of (B-1):(B-2)=95:5 and having a terminal structure represented by the following formula (B-3) in a mixed solvent of 60 parts of o-xylene, 40 parts of dimethoxymethane, and 2.7 parts of methyl benzoate. The coating liquid for the charge transport layer was applied onto the surface of the charge generating layer by dip coating. The resulting coating film was dried at 125° C. for 30 minutes to yield a 15.0 μm-thick charge transport layer.

(CT-1)

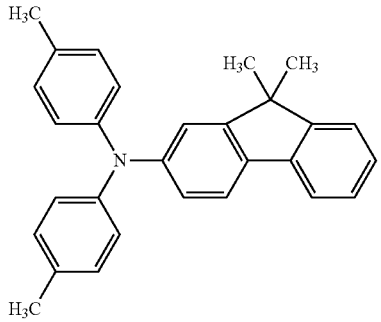

(CT-2)

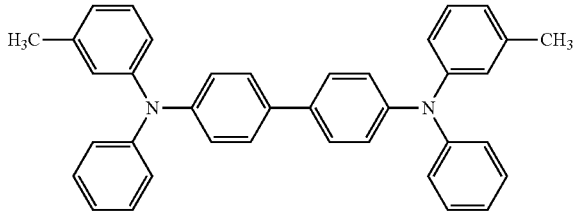

(B-1)

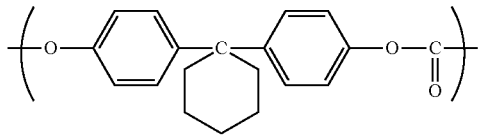

(B-2)

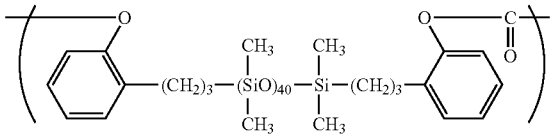

(B-3)

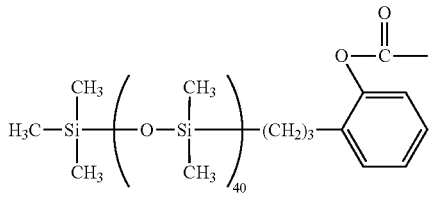

Thus, electrophotographic photosensitive member 1 having a charge transport layer as the surface layer was completed.

Electrophotographic Photosensitive Members 2 to 18 and C1 to C15

Electroconductive layer-forming coating liquid 1 used in the foregoing preparation of electrophotographic photosensitive member 1 was replaced with any one of electroconductive layer-forming coating liquids 2 to 14 and C1 to C13. Furthermore, the thickness of the electroconductive layer was changed as shown in Table 2. Other operation was performed in the same manner as in the preparation process of electrophotographic photosensitive member 1. Thus, electrophotographic photosensitive members 2 to 18 and C1 to C15 having a charge transport layer as the surface layer were prepared. The volume resistivity of the electroconductive layers was measured in the same manner as that of the electrophotographic photosensitive member 1. The results are shown in Table 2.

Evaluation

Variation in Potential of Electrophotographic Photosensitive Members

Each of the electrophotographic photosensitive member samples 1 to 18 and C1 to C15 was mounted in a laser beam printer Color LaserJet 3700 manufactured by Hewlett-Packard and subjected to a durability test performed by feeding printing paper at a normal temperature of 23° C. and a normal relative humidity of 50%. In this durability test, character patterns were printed with a print coverage of 2% on 6000 letter sheets in an intermittent mode in which printed sheets were outputted one by one.

The charged potential (dark portion potential) and the potential when exposed to light (bright portion potential) were measured before starting the durability test and after 6000-sheet output. For the potential measurement, a white solid pattern sheet and a black solid pattern sheet were used. The initial dark portion potential is represented as Vd and the initial bright portion potential is represented as Vl (each at the beginning of durability test). The dark portion potential after 6000-sheet output is represented as Vd', and the bright portion potential after 6000-sheet output is represented as Vl'. The difference between the initial dark portion potential Vd and the dark portion potential Vd' after 6000-sheet output, ΔVd (=|Vd|−|Vd'|), and the difference between the initial bright portion potential Vl and the bright portion potential Vl' after 6000-sheet output, ΔVl (=|Vl'|−|Vl|), were obtained. The results are shown in Table 2.

Optical Opacity of Electroconductive Layer

The optical opacity of the electroconductive layer was examined as described below. First, a coating film of each electroconductive layer-forming coating liquid was formed on a film Lumirror T60 (with a thickness of 100 μm, manufactured by Toray) under the same conditions as those for the preparation of the electrophotographic photosensitive member. The resulting coating film on the Lumirror was subjected to absorption spectrometry under the following conditions:

Measurement apparatus: ultraviolet-visible spectrophotometer JASCO V-570 manufactured by JASCO (measurement mode: Abs absorbance measurement, response: fast, band width: 2.0 nm, scanning speed: 2000 nm/min, Data capture interval: 2.0 nm, measurement wavelength range: 380 nm to 780 nm)

Since the ranking in absorbance of the samples did not vary from the ranking at a wavelength of 780 nm over the measurement wavelength range, the degree of optical opacity of each coating film with visible light was estimated by the absorbance at a wavelength of 780 nm. Table 2 shows absorbances at 780 nm obtained by the measurement.

TABLE 2

Test Results

| Example No. | Electrophotographic photosensitive member No. | Electroconductive layer-forming coating liquid No. | Electroconductive layer: Thickness (μm) | Electroconductive layer: Volume resistivity (Ω · cm) | Test results: Potential variation ΔVd (V) | Test results: Potential variation ΔVl (V) | Test results: Opacity absorbance |
|---|---|---|---|---|---|---|---|
| Example 1 | Electrophotographic photosensitive member 1 | Electroconductive layer-forming coating liquid 1 | 30 | $1 \times 10^{10}$ | 18 | 20 | 3.1 |
| Example 2 | Electrophotographic photosensitive member 2 | Electroconductive layer-forming coating liquid 2 | 30 | $1 \times 10^{10}$ | 18 | 21 | 2.9 |
| Example 3 | Electrophotographic photosensitive member 3 | Electroconductive layer-forming coating liquid 3 | 30 | $1 \times 10^{10}$ | 19 | 23 | 2.9 |
| Example 4 | Electrophotographic photosensitive member 4 | Electroconductive layer-forming coating liquid 4 | 30 | $1 \times 10^{12}$ | 22 | 27 | 3.1 |
| Example 5 | Electrophotographic photosensitive member 5 | Electroconductive layer-forming coating liquid 5 | 30 | $1 \times 10^{13}$ | 24 | 45 | 3.1 |
| Example 6 | Electrophotographic photosensitive member 6 | Electroconductive layer-forming coating liquid 6 | 30 | $1 \times 10^{12}$ | 22 | 25 | 3.1 |
| Example 7 | Electrophotographic photosensitive member 7 | Electroconductive layer-forming coating liquid 7 | 30 | $1 \times 10^{13}$ | 30 | 55 | 3.1 |
| Example 8 | Electrophotographic photosensitive member 8 | Electroconductive layer-forming coating liquid 8 | 30 | $1 \times 10^{13}$ | 33 | 65 | 3.1 |
| Example 9 | Electrophotographic photosensitive member 9 | Electroconductive layer-forming coating liquid 9 | 30 | $1 \times 10^{9}$ | 18 | 18 | 3.1 |
| Example 10 | Electrophotographic photosensitive member 10 | Electroconductive layer-forming coating liquid 10 | 30 | $1 \times 10^{8}$ | 20 | 20 | 3.1 |
| Example 11 | Electrophotographic photosensitive member 11 | Electroconductive layer-forming coating liquid 11 | 30 | $1 \times 10^{8}$ | 21 | 20 | 3.1 |
| Example 12 | Electrophotographic photosensitive member 12 | Electroconductive layer-forming coating liquid 1 | 20 | $1 \times 10^{10}$ | 18 | 18 | 2.5 |
| Example 13 | Electrophotographic photosensitive member 13 | Electroconductive layer-forming coating liquid 2 | 20 | $1 \times 10^{10}$ | 18 | 19 | 2.5 |
| Example 14 | Electrophotographic photosensitive member 14 | Electroconductive layer-forming coating liquid 3 | 20 | $1 \times 10^{10}$ | 18 | 19 | 2.5 |
| Example 15 | Electrophotographic photosensitive member 15 | Electroconductive layer-forming coating liquid 1 | 10 | $1 \times 10^{10}$ | 18 | 18 | 2.0 |
| Example 16 | Electrophotographic photosensitive member 16 | Electroconductive layer-forming coating liquid 12 | 30 | $1 \times 10^{10}$ | 20 | 22 | 3.1 |
| Example 17 | Electrophotographic photosensitive member 17 | Electroconductive layer-forming coating liquid 13 | 30 | $1 \times 10^{10}$ | 23 | 27 | 3.1 |
| Comparative Example 1 | Electrophotographic photosensitive member C1 | Electroconductive layer-forming coating liquid C1 | 30 | $1 \times 10^{10}$ | 20 | 30 | 2.9 |
| Comparative Example 2 | Electrophotographic photosensitive member C2 | Electroconductive layer-forming coating liquid C2 | 30 | $1 \times 10^{12}$ | 22 | 40 | 2.9 |
| Comparative Example 3 | Electrophotographic photosensitive member C3 | Electroconductive layer-forming coating liquid C3 | 30 | $1 \times 10^{13}$ | 25 | 50 | 2.9 |
| Comparative Example 4 | Electrophotographic photosensitive member C4 | Electroconductive layer-forming coating liquid C4 | 30 | $1 \times 10^{12}$ | 23 | 28 | 2.9 |
| Comparative Example 5 | Electrophotographic photosensitive member C5 | Electroconductive layer-forming coating liquid C5 | 30 | $1 \times 10^{13}$ | 30 | 60 | 2.9 |
| Comparative Example 6 | Electrophotographic photosensitive member C6 | Electroconductive layer-forming coating liquid C6 | 30 | $1 \times 10^{13}$ | 33 | 70 | 2.9 |
| Comparative Example 7 | Electrophotographic photosensitive member C7 | Electroconductive layer-forming coating liquid C7 | 30 | $1 \times 10^{9}$ | 20 | 25 | 2.9 |
| Comparative Example 8 | Electrophotographic photosensitive member C8 | Electroconductive layer-forming coating liquid C8 | 30 | $1 \times 10^{8}$ | 21 | 22 | 2.9 |
| Comparative Example 9 | Electrophotographic photosensitive member C9 | Electroconductive layer-forming coating liquid C9 | 30 | $1 \times 10^{8}$ | 22 | 22 | 2.9 |
| Comparative Example 10 | Electrophotographic photosensitive member C10 | Electroconductive layer-forming coating liquid C1 | 20 | $1 \times 10^{10}$ | 18 | 26 | 2.5 |
| Comparative Example 11 | Electrophotographic photosensitive member C11 | Electroconductive layer-forming coating liquid C1 | 10 | $1 \times 10^{10}$ | 18 | 25 | 2.0 |
| Comparative Example 12 | Electrophotographic photosensitive member C12 | Electroconductive layer-forming coating liquid C10 | 30 | $1 \times 10^{10}$ | 20 | 32 | 2.9 |
| Comparative Example 13 | Electrophotographic photosensitive member C13 | Electroconductive layer-forming coating liquid C11 | 30 | $1 \times 10^{10}$ | 25 | 34 | 2.9 |
| Comparative Example 14 | Electrophotographic photosensitive member C14 | Electroconductive layer-forming coating liquid C12 | 30 | $5 \times 10^{13}$ | 35 | 90 | 3.1 |
| Comparative Example 15 | Electrophotographic photosensitive member C15 | Electroconductive layer-forming coating liquid C13 | 30 | $5 \times 10^{9}$ | 20 | 35 | 0.1 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-230511 filed Nov. 30, 2017, which is hereby incorporated by reference herein in its entirety.

What is claimed is:

1. An electrophotographic photosensitive member comprising in this order:

a support member;

an electroconductive layer; and a photosensitive layer, wherein the electroconductive layer contains a binder resin having a refractive index Rb for a light ray having a wavelength of 780 nm, electrically conductive first metal oxide particles having a refractive index Rc for the light ray, and second metal oxide particles having a refractive index Rh for the light ray, the refractive indices Rb, Rc, and Rh satisfying the following relationships:

$$|Rb-Rc| \leq 0.35; \text{ and}$$

$$|Rb-Rh| \geq 0.65, \text{ and}$$

wherein the electroconductive layer has a volume resistivity of $1.0\times10^{6}$ Ω·cm to $1.0\times10^{13}$ Ω·cm, and the ratio Sc/Sh of the specific gravity Sc of the first metal oxide particles to the specific gravity Sh of the second metal oxide particles is 0.85 to 1.20.

2. The electrophotographic photosensitive member according to claim 1, wherein the second metal oxide particles comprise particles of at least one metal oxide selected from the group consisting of strontium titanate, barium titanate, and niobium oxide.

3. The electrophotographic photosensitive member according to claim 1, wherein the first metal oxide particles have a powder resistivity of 1.0 Ω·cm to $1.0\times10^{4}$ Ω·cm.

4. The electrophotographic photosensitive member according to claim 1, wherein the first metal oxide particles comprise barium sulfate particles coated with tin oxide.

5. An electrophotographic photosensitive member comprising in this order:

a support member;

an electroconductive layer; and a photosensitive layer, wherein the electroconductive layer contains a binder resin, first metal oxide particles, and second metal oxide particles, and wherein the first metal oxide particles comprise barium sulfate particles coated with tin oxide, and the second metal oxide particles comprise particles of at least one metal oxide selected from the group consisting of strontium titanate, barium titanate, and niobium oxide.

6. The electrophotographic photosensitive member according to claim 5, wherein the binder resin is one of a phenol resin and a urethane resin.

7. The electrophotographic photosensitive member according to claim 5, wherein the electroconductive layer has a volume resistivity of $1.0\times10^{8}$ Ω·cm to $1.0\times10^{12}$ Ω·cm.

8. The electrophotographic photosensitive member according to claim 5, wherein the first metal oxide particle content is 15% by volume to 40% by volume relative to the total volume of the electroconductive layer.

9. The electrophotographic photosensitive member according to claim 5, wherein the ratio of the first metal oxide particle content to the second metal oxide particle content in the electroconductive layer is 1:1 to 4:1 on a volume basis.

10. A process cartridge capable of being removably attached to an electrophotographic apparatus, the process cartridge comprising:

an electrophotographic photosensitive member including a support member, an electroconductive layer, and a photosensitive layer, in this order; and at least one device selected from the group consisting of a charging device, a developing device, a transfer device, and a cleaning device, the at least one device being held together with the electrophotographic photosensitive member in one body, wherein the electroconductive layer of the electrophotographic photosensitive member contains a binder resin, first metal oxide particles, and second metal oxide particles, and wherein the first metal oxide particles comprise barium oxide particles coated with tin oxide, and the second metal oxide particles comprise particles of at least one metal oxide selected from the group consisting of strontium titanate, barium titanate, and niobium oxide.

11. An electrophotographic apparatus comprising:

an electrophotographic photosensitive member including a support member, an electroconductive layer, and a photosensitive layer, in this order;

a charging device;

an exposure device;

a developing device; and a transfer device, wherein the electroconductive layer of the electrophotographic photosensitive member contains a binder resin, first metal oxide particles, and second metal oxide particles, and wherein the first metal oxide particles comprise barium oxide particles coated with tin oxide, and the second metal oxide particles comprise particles of at least one metal oxide selected from the group consisting of strontium titanate, barium titanate, and niobium oxide.

* * * * *